US008457969B2

(12) United States Patent
Ae

(10) Patent No.: US 8,457,969 B2
(45) Date of Patent: Jun. 4, 2013

(54) AUDIO PITCH CHANGING DEVICE

(75) Inventor: Takahiro Ae, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 516 days.

(21) Appl. No.: 12/871,829

(22) Filed: Aug. 30, 2010

(65) Prior Publication Data

US 2011/0054886 A1 Mar. 3, 2011

(30) Foreign Application Priority Data

Aug. 31, 2009 (JP) ..... 2009-201008

(51) Int. Cl.
*G10L 13/06* (2006.01)
*G10H 1/02* (2006.01)

(52) U.S. Cl.
USPC ..... 704/268; 84/626

(58) Field of Classification Search
USPC ..... 704/258–269; 84/600–645
See application file for complete search history.

(56) References Cited

U.S. PATENT DOCUMENTS 5,642,470 A * 6/1997 Yamamoto et al. ..... 704/270
5,940,797 A * 8/1999 Abe ..... 704/260
5,950,152 A * 9/1999 Arai et al. ..... 704/207
5,955,693 A * 9/1999 Kageyama ..... 84/610
7,249,022 B2 * 7/2007 Kayama et al. ..... 704/267

* cited by examiner

*Primary Examiner* — Samuel G Neway
(74) *Attorney, Agent, or Firm* — Foley & Lardner LLP

(57) ABSTRACT

An effect device may be configured such that when an input audio signal switches from a consonant to a vowel and an input level of the switched vowel is greater than a threshold value Lc (and a variable t is greater than time Ts), an audio effect signal A may be generated. Such an effect device may allow for increasing the occurrences when portamento is simulated, while still sounding natural. In general, a detecting module detects whether an audio signal is a vowel sound or a consonant sound and whether the audio signal changed from a consonant sound to a vowel sound; and a pitch change module changes a pitch of the audio signal and changes, based on a prescribed function, an amount the pitch is changed to produce a modified audio signal, when the audio signal changed from a consonant sound to a vowel sound.

19 Claims, 4 Drawing Sheets

AUDIO PITCH CHANGING DEVICE

CROSS-REFERENCE TO RELATED PATENT APPLICATIONS

Japan Priority Application 2009-201008, filed Aug. 31, 2009 including the specification, drawings, claims and abstract, is incorporated herein by reference in its entirety.

BACKGROUND

1. Field of the Invention

Embodiments of the present invention generally relate to effect device systems and methods, and particularly to effect device systems and methods for obtaining the unison effect (doubling effect) of singing by simulating portamento that is a characteristic of singing.

2. Related Art

Prior effect devices mix an audio effect signal that are like multiple people singing the same melody (unison effect, or doubling effect) with a music signal that has been input (with respect to solo singing). In recording studios, an effect sound can be provided to an audio signal (e.g., of a solo singer) with an effect device sometimes known as a doubling effector so that the effect sound is interesting and exhilarating. With such a device, a delay is applied to the input audio signal. Some known methods obtain a unison effect by mixing the delayed audio signal and the original audio signal. However, with only a fixed percentage of a delay effect applied, the obtained unison effect is uniform and/or otherwise unnatural (not like a human singing).

Japanese patent number 3903975 discloses a musical note processor that detects the start (attack) of the singing of a song and causes the continuous pitch change, which converges on the original pitch (musical interval) of the sound of the input audio signal, that simulates the portamento effect at the start (attack) of the singing of a phrase of a song's lyric. With this method, the sound volume level of the audio signal that has been input is detected; and only when that sound volume level has changed from less than a threshold value to a threshold value or more, is the pitch of the audio signal that has been input caused to greatly change; and an audio effect signal that has simulated the portamento effect is generated to obtain a kind of unison effect by simulating one of the characteristics of human singing.

Furthermore, what is called "portamento" here is something that indicates one type of feedback phenomenon, which can be typically found at the start of singing a phrase of a song lyric. That is, the pitch of the song diverges (goes apart) from the original pitch at the start of the song lyric or in the middle of a phrase, for example, and then the pitch of the song converges on the original pitch while the singer hears the pitch of his or her own voice and continues singing (or utterance).

The musical note processor mentioned in Japanese patent 3903975 generates an audio effect signal as follows. It carries out sampling of the pitch, sound volume level, and spectrum of the audio signal that has been input and then analyzes the audio signal that has been input. Moreover, from the sampled spectrum, it carries out a judgment of whether the audio signal that has been input is a voiced sound or a voiceless sound. When it is a voiceless sound, it carries out modulation by means of a pseudo-random signal with respect to the pitch and sound volume level of the audio signal that has been input and generates the audio effect signal of the doubling effector. Furthermore, voiced sounds, in addition to the vowels (the respective sounds of a, i, u, e, o), indicate part of the plosive sounds (the respective sounds of b, d, g), part of the fricative sounds (the respective sounds of v, z), the nasal sounds (the respective sounds of m, n), and the liquid sounds (the respective sounds of l, r), and the voiceless sounds indicate part of the plosive sounds (the respective sounds of p, t, k) and part of the fricative sounds (f, s).

When based on the conventional doubling effector, as described above, an audio effect signal that includes the effect that has simulated portamento is generated only when the sound volume level of the audio signal that has been input has changed from less than a threshold value to a threshold value or more, which happens typically at the start of a phrase (of a song lyric). Accordingly, simulating portamento is not possible when the state continues in which the sound volume level of the input signal that has been input is at or above the threshold value (i.e., in the state in which the singing is carried out continuously (e.g., midway into a phrase)). This is one of the reasons why the conventional doubling effector cannot achieve natural doubling effect for a human voice singing; as in a real human voice singing, you will find the "portamento" phenomena more frequent, not only at the beginning of the phrase, but also midway into a phrase. Thus, the conventional doubling effector runs short of generating the portamento effect in the middle of the phrase, which produces a poor doubling effect sound.

Furthermore, in the musical note processor mentioned in Japanese patent number 3903975, when the input audio signal is voiceless, the audio effect signal of the doubling effector is generated. Accordingly, in the state in which the input audio signal changes from a voiced sound to a different type of voiced sound, specifically, for example, changing vowel sounds from nasal sounds and liquid sounds, no audio effect signal is generated. Thus, the frequency of occurrences of the doubling effect signal (a rate at which the doubling effect signal can be obtained) is limited (e.g., not often enough), which produces a poor doubling effect sound for one-person singing.

SUMMARY OF THE DISCLOSURE

An effect device may comprise, but is not limited to, an input means, an effect providing means, and an output means. The input means may be for inputting an audio signal. The effect providing means may be for acquiring the audio signal at a plurality of times. The effect providing means may be for providing an effect to the acquired audio signal to produce an audio effect signal. The output means may be for outputting the audio effect signal.

The effect providing means may include, but is not limited to, a determination means, a detection means, a first change means, a first convergence means, and a first output means. The determination means may be for determining whether the acquired audio signal is a vowel or a consonant. The detection means may be for detecting whether the acquired audio signal was switched from a consonant to a vowel. The first change means may be for changing a pitch of the acquired audio signal by an amount when the detection means detects that the acquired audio signal was switched from a consonant to a vowel. The first convergence means may be for converging the amount the pitch is changed by the first change means to a value based on a prescribed function. The first output means may be for outputting the converged audio signal as the audio effect signal to the output means.

When the detection means detects that the acquired audio signal has switched from a consonant to a vowel, the first change means changes the pitch of the acquired audio signal. At this time, the first convergence means converges the pitch change amount to a defined amount indicated by a prescribed function. Then, the first output means outputs the resulting signal to the output means as an audio effect signal. The output means outputs the audio effect signal mixed with the (input) audio signal.

As such, when the detection means detects that the acquired audio signal has switched from a consonant to a vowel, the effect device can generate an audio effect signal that includes an effect that simulates portamento (hereinafter, called audio effect signal A) by changing the pitch of the acquired audio signal.

Here, a consonant means the sounds other than vowels (the respective sounds of a, i, u, e, o), namely, the plosive sounds (the respective sounds of b, d, g, p, t, k), the fricative sounds (the respective sounds of v, z, f, s), the nasal sounds (the respective sounds of m, n), and the liquid sounds (the respective sounds of l, r). Accordingly, the effect device can generate an audio effect signal A that includes an effect that simulates portamento even when switching between voiced sounds. For example (but not limited to), when switching from nasal consonant sounds or liquid consonant sounds (both of which belong to voiced sounds) to a vowel sound (which also belongs to voiced sounds). As such, the simulation of portamento can be carried out (to obtain the unison or doubling effect of singing) more frequently when compared to conventional doubling effect, which generates simulated portamento effect sound only at the beginning of a phrase of a song lyric. Thus, the effect device can better simulate portamento of a real human singing and consequently achieve natural doubling effect for human voice singing.

In various embodiments, the effect providing means may include, but is not limited to, an amplitude detection means and an amplitude decision means. The amplitude detection means may be for detecting an amplitude of the acquired audio signal when the detection means detects that the acquired audio signal was switched from a consonant to a vowel. The amplitude decision means may be for deciding whether the amplitude is above a first threshold value. The first change means may comprise an execution means for executing the pitch change of the acquired audio signal, when the amplitude decision means decides that the amplitude is above the first threshold value.

Accordingly, even when the audio signal switches from a consonant to a vowel, the audio effect signal A can be generated only when the first threshold value of the amplitude is exceeded. As such, the simulation of portamento can be carried out in fewer instances, which may better simulate portamento of a real human singing, for instance when considering the following tendencies during a singer's performance. Singers carry out portamento at the beginning of a phrase (of a song lyric) and in the middle of a phrase when singing it loud. On the contrary, singers would not carry out portamento in the middle of a phrase during steady singing in a low voice with less emotional expression.

In various embodiments, the effect providing means may include, but is not limited to, a vowel amplitude detection means, a vowel amplitude decision means, a continuous vowel detection means, an amplitude change detection means, an amplitude change decision means, a second change means, a second convergence means, and a second change output means.

The vowel amplitude detection means may be for detecting an amplitude of the acquired audio signal when the determination means determines that the acquired audio signal is a vowel. The vowel amplitude decision means may be for deciding whether the amplitude is above a threshold. The continuous vowel detection means may be for detecting whether a previous audio signal acquired at a previous time is determined by the determination means to be a vowel, when the vowel amplitude decision means decides that the amplitude is above the threshold. The amplitude change detection means may be for detecting a difference of the amplitude amount (audio level) between the amplitude of the acquired audio signal and the amplitude of the previous acquired audio signal, when the continuous vowel detection means detects the previous audio signal is a vowel. The amplitude change decision means may be for deciding whether the difference of the amplitude amount exceeds the second threshold value. The second change means may be for changing the pitch of the acquired audio signal by an amount, when the amplitude change decision means decides the difference of the amplitude amount is above the prescribed value. The second convergence means may be for converging the amount the pitch is changed by the second change means to a value based on the prescribed function. The second change output means may be for outputting the converged audio signal, received from the second convergence means, as the audio effect signal A to the output means.

Accordingly, even if the audio signal does not change from a consonant to a vowel, when the difference of the amplitude amount between the amplitude of the acquired audio signal and the amplitude of the previously acquired audio signal are sufficiently large (e.g., greater than the second threshold), the audio effect signal A that includes the simulated portamento effect can be generated. As such, the simulated portamento effect can be generated not just when an audio signal changes from a consonant to a vowel, but also when an audio signal changes from a vowel to a vowel if the above conditions are met. This is an additional occasion of the simulated portamento effect, and this embodiment may contribute to creating better doubling effect sound because it makes the doubling effect sound much like a natural singing performance by a human singer.

In some embodiments, the effect providing means may include, but is not limited to, a timing means, a timing decision means and a timing decision execution means. The timing means may be for timing the sum amount of time i) when the vowel amplitude detection means detects the acquired audio signal was a vowel and the vowel amplitude decision means decides the amplitude of the voice is less than the threshold and ii) when the determination means determines the acquired audio signal is a consonant. The timing decision means may be for deciding whether the sum amount of time exceeds a prescribed time. The timing decision execution means may be for executing the pitch change of the acquired audio signal done by either the first change means or the second change means, when the timing decision means decides that the amount of time exceeds the prescribed time.

Thus, only when the sum amount of time exceeds the prescribed time will either the first change means or the second change means change the pitch, and thus permit the generation of the audio effect signal A that includes the effect that has simulated portamento. As such, these embodiments allow for simulation of portamento in some cases while inhibiting the occurrence of simulation of portamento in other cases much like a natural singing performance by a human singer.

Furthermore, inserting portamento continuously so frequently (so many times) in each syllable midway in a phrase is unnatural; a human singer, on the other hand, knows where to insert portamento. Accordingly, it can be understood that the continuous occurrence of a separate portamento in a phrase is said to be rare.

Listening carefully to a real human singing, once a portamento is inserted, there is a time interval until the next portamento is inserted, which means a sufficient time interval may be necessary before the next portamento effect is inserted in a phrase. Yet further, portamento rarely occurs during short notes sung in a phrase. For example, in a medium tempo song, when being continuously sung (uttered words of lyric) at a timing of 16th notes, the provision of the portamento effect is rare. These tendencies are well-known facts that can be easily recognized by analytically appreciating singing, and that is why such embodiments closely simulate the characteristics of this kind of singing.

In various embodiments, the effect providing means may include a pitch change means for randomly changing the amount the pitch is changed by the second change means. Consequently, the portamento simulated by the audio effect signal may be varied. As a result, the simulation of portamento can be made more natural.

In various embodiments, the effect providing means may include a convergence change means for randomly changing the prescribed function to change the degree (depth) of convergence accordingly. Accordingly, the degree and duration of change of the portamento simulated by the audio effect signal A can be changed randomly. Consequently, the portamento simulated by the audio effect signal A may be varied. As a result, the simulation of portamento can be made more natural.

In various embodiments, the effect providing means may include a shaking providing means for providing a random shaking to the pitch of the converged audio signal. Accordingly, vibrato can be provided to the audio effect signal. Consequently, the audio effect signal A can be made more natural.

An effect device may comprise, but is not limited to, an input device, an effect processor, and an output device. The input device may be for inputting an audio signal. The effect processor may be configured to acquire the audio signal. The effect processor may be configured to provide an effect to the acquired audio signal to produce an audio effect signal. The output device for outputting the audio effect signal The effect processor may include, but is not limited to, a determination module, an amplitude detection module, an amplitude decision module, a continuity detection module, an amplitude change detection module, an amplitude change decision module, a pitch change module, and a pitch convergence module. The determination module may be configured to determine whether the acquired audio signal is a vowel or a consonant. The amplitude detection module may be configured to detect an amplitude of the acquired audio signal when the determination module determines that the acquired audio signal is a vowel. The amplitude decision module may be configured to decide whether the amplitude is above a threshold. The continuity detection module may be configured to detect whether a previous audio signal acquired at a previous time is determined by the determination module to be a vowel, when the amplitude decision module decides that the amplitude is above the threshold. The amplitude change detection module may be configured to detect a change amount between the amplitude of the acquired audio signal and the amplitude of the previous acquired audio signal, when the continuity detection module detects the previous audio signal is a vowel. The amplitude change decision module may be configured to decide whether the change amount is above a prescribed value. The pitch change module may be configured to change the pitch of the acquired audio signal by an amount, when the amplitude change decision module decides the change amount is above the prescribed value. The pitch convergence module may be configured to converge the amount the pitch is changed by the pitch change module to a value based on the prescribed function to produce the audio effect signal.

The effect providing means may include, but is not limited to, a determination means, a vowel amplitude detection means, a vowel amplitude decision means, a continuous vowel detection means, an amplitude change detection means, an amplitude change decision means, a change means, a convergence means, an output means. The determination means may be for determining whether the acquired audio signal is a vowel or a consonant. The vowel amplitude detection means may be for detecting an amplitude of the acquired audio signal when the determination means determines that the acquired audio is a vowel. The vowel amplitude decision means may be for deciding whether the amplitude is above a threshold. The continuous vowel detection means may be for detecting whether a previous audio signal acquired at a previous time is determined by the determination means to be a vowel, when the vowel amplitude decision means decides that the amplitude is above the threshold. The amplitude change detection means may be for detecting a change amount between the amplitude of the acquired audio signal and the amplitude of the previous acquired audio signal, when the continuous vowel detection means detects the previous audio signal is a vowel. The amplitude change decision means may be for deciding whether the change amount is above a prescribed value. The change means may be for changing the pitch of the acquired audio signal by an amount, when the amplitude change decision means decides the change amount is above the prescribed value. The convergence means may be for converging the amount the pitch is changed by the change means to a value based on the prescribed function. The change output means may be for outputting the converged audio signal, received from the convergence means, as the audio effect signal to the output means.

An effect device may include, but is not limited, an input terminal, a processor, and an output terminal. The input terminal may be for receiving an audio signal. The processor may be configured produce a modified audio signal by applying an effect to the audio signal. The output terminal may be for outputting the modified audio signal.

The processor may include, but is not limited to, a detecting module and a pitch change module. The detecting module may be configured to detect whether the audio signal comprises a vowel sound or a consonant sound. The detecting module may be configured to detect whether the audio signal changed from a consonant sound to a vowel sound. The pitch change module configured to change a pitch of the audio signal. The pitch change module may be configured to change, based on a prescribed function, an amount the pitch of the audio signal is changed to produce the modified audio signal, when the detecting module detects that the audio signal changed from a consonant sound to a vowel sound.

In various embodiments, the processor may include an amplitude detection module configured to detect an amplitude of the audio signal when the detecting module determines that the audio signal changed from a consonant sound to a vowel sound. The amplitude detection module may be configured to determine whether the amplitude exceeds a first threshold value. The pitch change module may be configured to change the pitch of the audio signal when the amplitude exceeds the first threshold value.

In various embodiments, the processor may include an amplitude detection module configured to detect an amplitude of the audio signal when the detecting module determines that the audio signal changed from a consonant sound to a vowel sound. The amplitude detection module may be configured to determine whether the amplitude exceeds a first threshold value. The amplitude detection module may be configured to determine an amplitude of the audio signal at a previous time when the detection module determines that the audio signal was a vowel sound and the amplitude detection module determines that the amplitude exceeds a second threshold value. The amplitude detection module may be configured to determine whether the amplitude at the previous time exceeds the threshold value. The amplitude detection module may be configured to calculate a difference between the amplitude of the audio signal and the amplitude of the audio signal at the previous time. The amplitude detection module may be configured to determine whether the difference exceeds a prescribed value. The pitch change module may be configured to change the pitch of the audio signal. The pitch change module may be configured to change, based on the prescribed function, the amount the pitch of the audio signal is changed to produce the modified audio signal, when the amplitude detection module determines that difference exceeds the prescribed value.

In various embodiments, the processor may include a timer configured to measure a sum amount of a duration in which the amplitude of the audio signal is below the threshold value and a duration in which the audio signal is a consonant sound. The pitch change module may be configured to change the pitch of the audio signal when the sum amount of the duration exceeds a predetermined value.

In various embodiments, the processor may include a random signal generator. The pitch change module may be configured to randomly change the amount of pitch change based on a random signal generated by the random signal generator.

In various embodiments, the processor may include a random signal generator. The pitch change module may be configured to randomly change the prescribed pitch convergence function based on a random signal generated by the random signal generator.

In various embodiments, the processor may include a random signal generator. The pitch change module may be configured to provide random shaking on pitch (vibrato) to the audio signal based on a random signal generated by the random signal generator.

DETAILED DESCRIPTION

Figure 1:
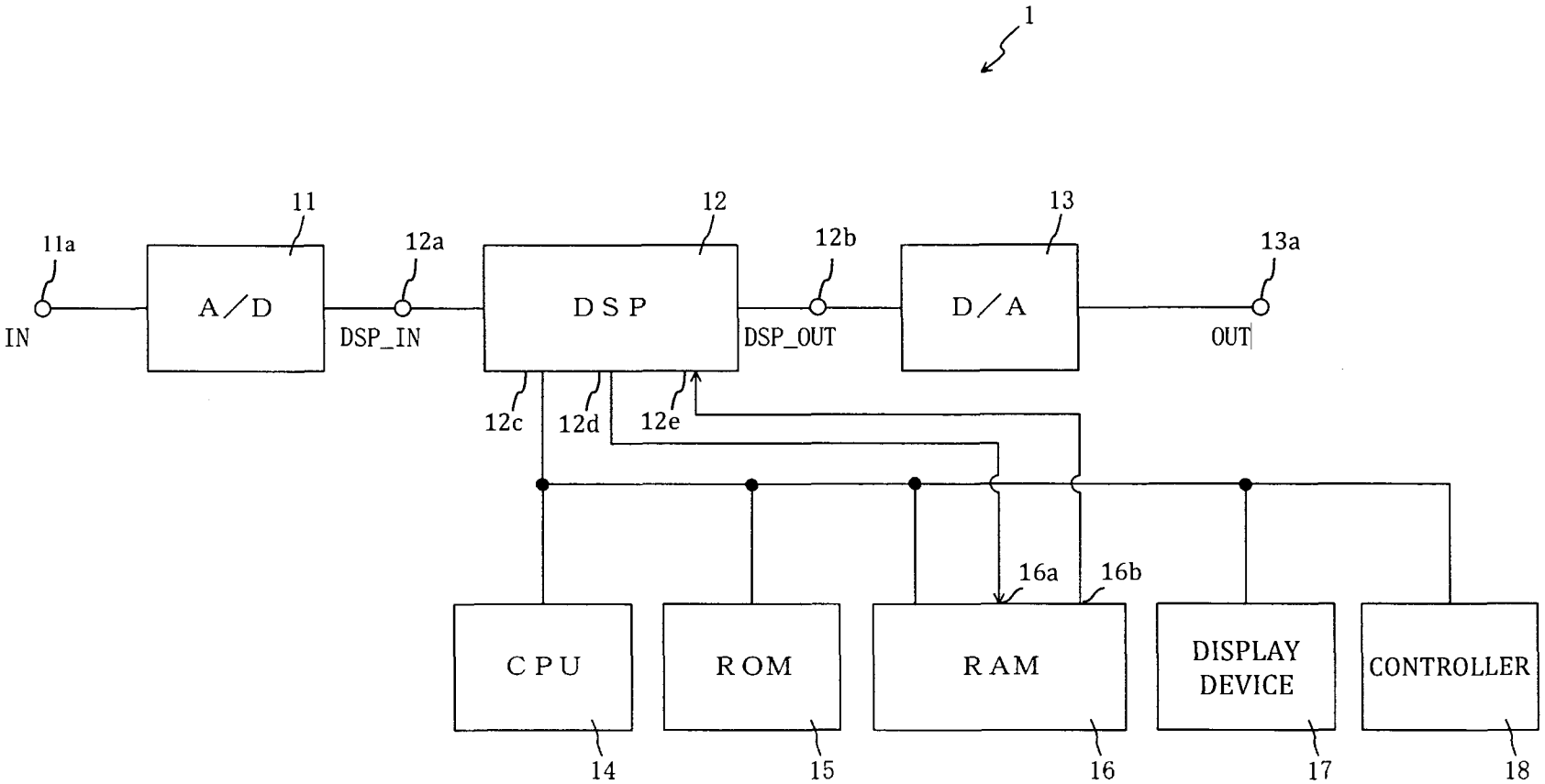
FIG. 1 is a block diagram that shows an electrical configuration of an effect device according to an embodiment of the present invention.

FIG. 1 illustrates an electrical configuration of an effect device 1 according to an embodiment of the present invention. In various embodiments, the effect device 1 may increase the frequency of occurrences of portamento simulation. The effect device 1 may comprise an analog digital converter (A/D Converter) 11, a digital signal processor (DSP) 12, a digital analog converter (D/A Converter) 13, a CPU 14, ROM 15, RAM 16, a display device 17, and a controller 18.

The A/D Converter 11 may be electrically connected to an IN terminal 11*a* and a DSP_IN terminal 12*a*. The DSP 12 may be electrically connected to the DSP_IN terminal 12*a* and a DSP_OUT terminal 12*b*. The D/A Converter 13 may be electrically connected to the DSP_OUT terminal 12*b* and an OUT terminal 13*a*.

The A/D Converter 11 may be configured to convert an analog audio signal inputted to the IN terminal 11*a* into a digital audio signal. The digital audio signal may be outputted to the DSP_IN terminal 12*a*.

The DSP 12 may comprise a processor or the like configured to process the digital audio signal inputted to the DSP_IN terminal 12*a* (i.e., outputted from the A/D converter 11). The digital audio signal may be distributed in (at least) two ways. The DSP 12 may provide an effect to the digital audio signal (inputted to the DSP_IN terminal 12*a*), and then mix the audio effect signal with the digital audio signal (inputted to the DSP_IN terminal 12*a*). The mixed signal may be outputted (by the DSP 12) to the DSP_OUT terminal 12*b*.

The D/A Converter 13 may be configured to convert the mixed signal (the signal in which the digital audio signal and the audio effect signal are mixed together) inputted to the DSP_OUT terminal 12*b* (i.e., outputted from the DSP 12) to an analog signal. The analog signal may be outputted to the OUT terminal 13*a*.

The DSP 12 may further include a control terminal 12*c*, a write terminal 12*d*, and a read terminal 12*e*. The control terminal 12*c* may be electrically connected with the CPU 14, the ROM 15, the RAM 16, the display device 17, and the controller 18. The CPU 14 may be configured to control the DSP 12 as well as the ROM 15, the RAM 16, the display device 17, and the controller 18.

Figure 3:
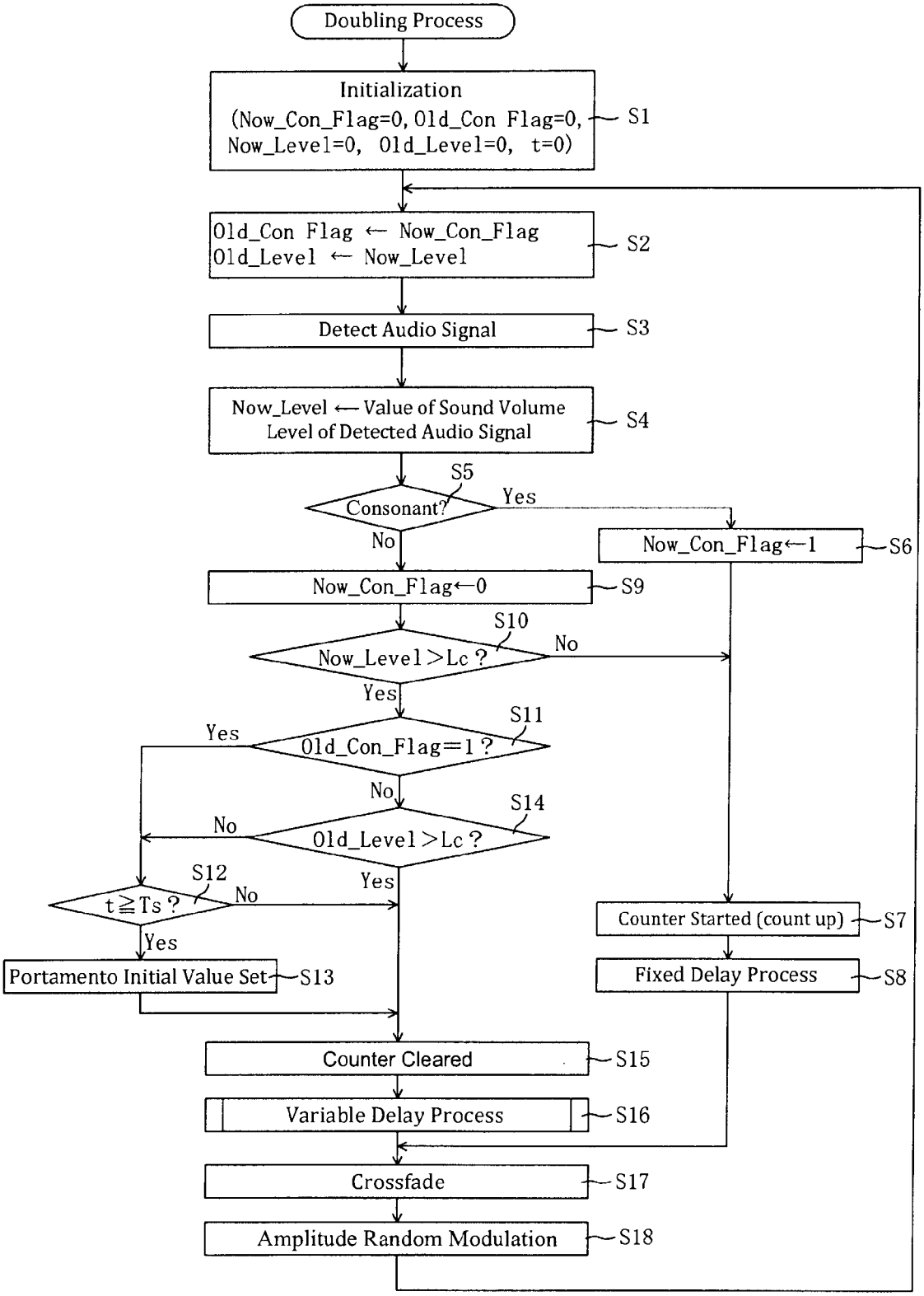
FIG. 3 is a flowchart of a signal process executed by a digital signal processor according to an embodiment of the present invention.

The ROM 15 may be non-rewritable memory on which a control program (and/or the like) for execution by the effect device 1 is stored (e.g., the signal process of FIG. 3). The RAM 16 may be memory for temporarily storing various kinds of data. The RAM 16 may include an input terminal 16*a* for receiving data and an output terminal 16*b* for transmitting data. The write terminal 12*d* may be connected to the input terminal 16*a* of the RAM 16.

The RAM 16 may include a buffer, such as a ring buffer, in which the audio signal transmitted from the DSP 12 to the RAM 16 is read and written. As known in the art, a delay and a pitch change of a signal may be obtained by controlling the read/write operation of the ring buffer. Based on the write speed of a predetermined write address pointer (number of steps of write address per unit of time), the ring buffer may store the audio signal output from the write terminal 12*d* of the DSP 12 sequentially in output time order. The audio signal stored in the RAM 16 may be referred to as the divided audio signal.

The read terminal 12*e* of the DSP 12 may be connected to the output terminal 16*b* of the RAM 16. As such, the DSP 12 can sequentially read the divided audio signal from the RAM 16 via the read terminal 12*e* in response to the read speed of the read address pointer (number of steps of read address per unit of time).

At this time, because the read address of the read address pointer designates the address before the address of the write pointer, a delay occurs. The read speed (by use of the read address pointer) may be made faster than the write speed (by use of the write address pointer) to raise the pitch. Conversely, the read speed may be made slower than the write speed to lower the pitch.

The display device 17 may be configured to display a configuration state of the effect device 1 and/or a plurality of operation states. The display device 17 may comprise any suitable electronic visual display including, but not limited to, an LCD (liquid crystal display), LED (light emitting diode) display, OLED (organic light emitting diode), or the like. The controller 18 may be an input device for carrying out configuration and/or operation changes of the effect device 1.

Figure 2:
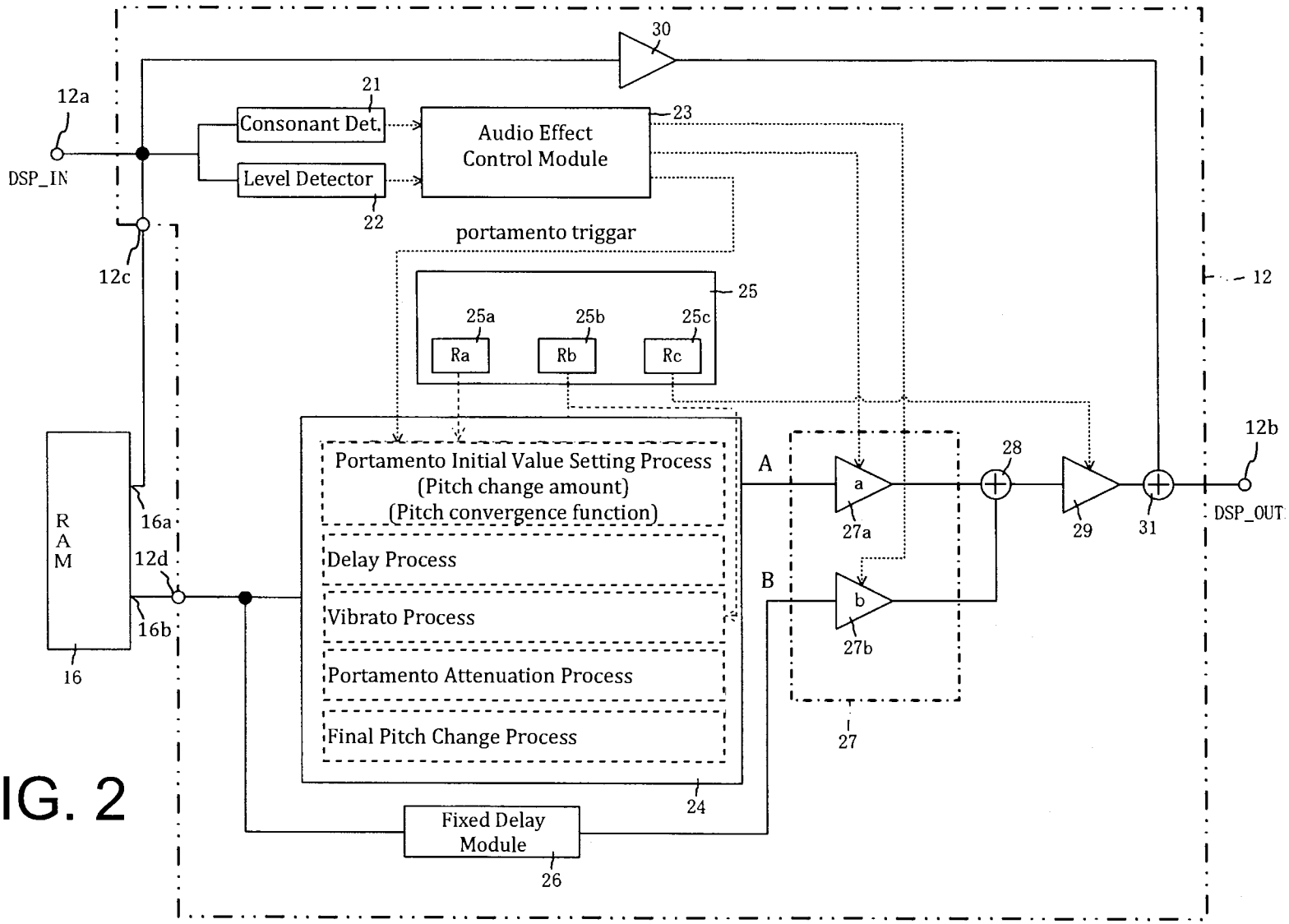
FIG. 2 is a functional block diagram of a signal process executed by a digital signal processor according to an embodiment of the present invention.

FIG. 2 is a functional block diagram of a signal process executed by the DSP 12 according to an embodiment of the present invention. The DSP 12 may comprise (but is not limited to) a consonant detection module 21, a level detection module 22, an audio effect control module 23, a variable delay module 24, a random signal generating module 25, a fixed delay module 26, a crossfade module 27, a mixer 28, an amplitude control module 29, an audio signal amp 30, and a final stage mixer 31.

In various embodiments, the effect device 1 may be configured to provide a natural unison effect (simulated human voice effect for a unison ensemble). In further embodiments, the effect device 1 may be configured to provide a natural unison effect in the case of solo (a single singer's) performance.

In some embodiments, the natural unison effect can be obtained through use of (but not limited to) a slippage (delay), vibrato (pitch fluctuation 1), portamento (pitch fluctuation 2), and sound volume fluctuation (level fluctuation).

The slippage (delay) may be implemented by the variable delay module 24 and the fixed delay module 26. The vibrato (pitch fluctuation 1) may be implemented by the vibrato process (e.g., step S21 discussed later) in the variable delay module 24. The portamento (pitch fluctuation 2) may be implemented by the portamento initial value setting process (e.g., step S13 discussed later) and the portamento attenuation process (e.g., step S22 discussed later) in the variable delay module 24. The sound volume fluctuation (level fluctuation) may be implemented by the amplitude control module 29.

The vibrato, portamento, and sound volume fluctuation may receive a random signal from the random signal generating module 25 to randomly generate a fluctuation of each element. The amount of slippage and the initial value of the pitch convergence function may be obtained randomly because of a random value setting of the portamento initial value setting process. The slippage and the pitch convergence function may be used for the portamento attenuation process, and both, as discussed later, allows for a random delay upon being triggered.

Each time a singer performs (i.e., sings) the same lyrics of a song, there will be different nuances. Because a singer is a human being, it is extremely difficult to reproduce the above-mentioned four singing nuances in exactly the same way. Generally speaking, it is not possible to sing a song with the identical nuances. In other words, with random expression for singing, we can recognize the performance as a natural (not an artificial) vocal singing. This is the reason why the effect device 1 is able to provide a natural unison effect through random fluctuations of some or all of these elements.

The consonant detection module 21 may detect a result of whether the audio signal output from the DSP_IN terminal 12*a* is a vowel or a consonant. The consonant detection module 21 may output the detected result to the audio effect control module 23.

The level detection module 22 may detect an amplitude (audio level) of the audio signal output from the DSP_IN terminal 12*a*. The level detection module 22 may output the audio level to the audio effect control module 23. The respective processes of the consonant module 21 and the level detection module 22 may be repeated for each prescribed timing of the doubling process (refer to FIG. 3).

Based on the result of the consonant module 21 and the audio level of the level detection module 22, the audio effect control module 23 may output a portamento trigger signal to the variable delay module 24. The portamento trigger signal may be for controlling the portamento initial value setting process, as will be described later. The audio effect control module 23 may output a first control signal and a second control signal to the crossfade module 27.

The variable delay module 24 may generate an audio effect signal A in certain instances, as detailed below, in response to the portamento trigger signal received from the audio effect control module 23. The variable delay module 24 may output the audio effect signal A to a first amp 27*a* of the crossfade module 27.

When the divided audio signal is a consonant (e.g., step S5: Yes, in FIG. 3) or the sound volume level of the divided audio signal is below a threshold level (e.g., step S10: No, in FIG. 3), the fixed delay module 26 may set the prescribed time of the position of the read address pointer before the position of the write address pointer, for example, to a position where a delay of 20 ms occurs and carry out the reading of the divided audio signal from the RAM 16 at the same speed as the write speed of the write pointer. Accordingly, the fixed delay module 26 may generate an audio effect signal B. (Note that the audio effect signal B does not contain a portamento effect.) The fixed delay module 26 may output the audio effect signal B to a second amp 27*b* of the crossfade module 27.

As will be described, the reading of the divided audio signal in the RAM 16 is always carried out by both the variable delay module 24 and the fixed delay module 26 and output to the crossfade module 27, which outputs exclusively to the mixer 28 either one of the audio effect signal A from the variable delay module 24 or the audio effect signal B from the fixed delay module 26.

Furthermore, as long as the variable delay module 24 does not receive the portamento trigger signal from the audio effect control module 23, the variable delay module 24 adds the prescribed pitch change amount based on the vibrato process (discussed later) to the delay process that causes a prescribed delay (e.g., 20 ms), which is the same as the fixed delay module 26. The variable delay module 24 reads the divided audio signal from the RAM 16 and outputs the audio effect signal A to the first amp 27*a* of the crossfade module 27.

Thus, the divided audio signal is output to the crossfade part 27 via either the variable delay module 24 or the fixed delay module 26. Accordingly, as long as the variable delay module 24 does not receive the portamento trigger from the audio effect control module 23, the audio signal that has been inputted (into the DSP_IN terminal 12*a* of the DSP 12) is outputted after being delayed the prescribed time duration. This delay may allow for sufficient time for many of the processes of the DSP 12, to be carried out, as described before, for instance, determining whether or not the portamento effect should be generated, determining whether or not the acquired audio signal was a vowel or consonant, detecting whether or not the acquired audio signal was switched from a consonant to a vowel, detecting an amplitude of the acquired audio signal, and/or deciding whether or not the amplitude of the acquired audio signal was above a first threshold value.

Figure 4:
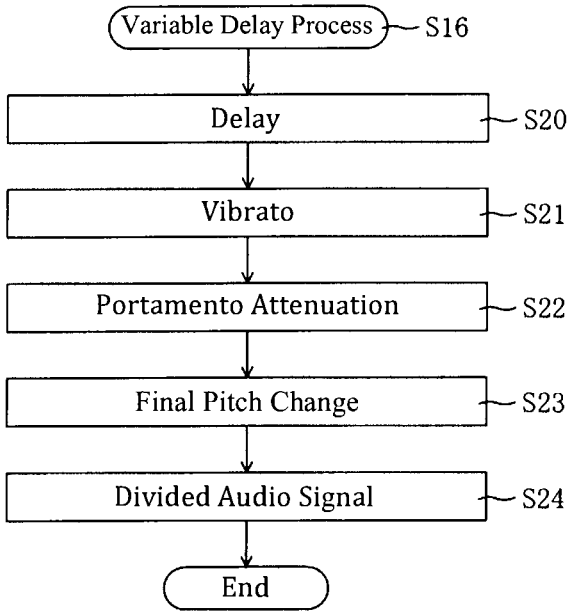
FIG. 4 is a flowchart of a variable delay process according to an embodiment of the present invention.

When the variable delay module 24 receives the portamento trigger from the audio effect control module 23, the variable delay module 24 may add an initial pitch change amount and pitch convergence function obtained by the portamento initial value setting process (e.g., step S13 in FIG. 3) to the final pitch change process (e.g., step S23 in FIG. 4), which includes the vibrato process (e.g., step S21 in FIG. 4) and the portamento attenuation process (e.g., step S22 in FIG. 4). Finally, the final pitch change amount obtained by the final pitch change process is added to the delay process that causes the prescribed delay (e.g., 20 ms). The variable delay module 24 reads the divided audio signal from the RAM 16 and outputs the audio effect signal A to the crossfade module 27.

As explained before, the final pitch change process comprises three processes: i) the portamento initial value setting process (e.g., step S13 in FIG. 3), ii) the portamento attenuation process, and iii) the vibrato process. The final pitch process mixes the result of each of these three processes together, and determines the final pitch change amount.

In the portamento initial value setting process (e.g., step S13 in FIG. 3), when the valuable delay module 24 receives the portamento trigger signal from the audio effect control module 23, an initial pitch change amount is decided with a pitch change direction whether the pitch of the divided audio signal acquired from the RAM 16 changes high or changes low (hereinafter, called "pitch change direction"). In addition, a pitch convergence function is decided, too. The initial pitch change amount with a pitch change direction and the pitch convergence function are decided at random.

In the portamento attenuation process (e.g., step S22 in FIG. 4), when the pitch of the divided audio signal is changed by the initial pitch change amount with the pitch change direction and the pitch convergence function that regulates the convergence speed and elapsed time (as determined by the portamento initial value setting process), the portamento attenuation may be done along with the convergence speed and curve that is provided by the pitch convergence function in order to cause that change amount to converge on zero with sufficient time duration for convergence.

In the vibrato process (e.g., step S21 in FIG. 4), the amount of shaking (vibrato) to be given to the pitch that changes is determined at all times (as discussed later).

First, the default setting of the delay process (e.g., 20 ms) is carried out by setting the read position of the read pointer at the same address as the read position of the read pointer of the fixed delay module 26 in order to generate the prescribed delay at the same delay time. In general, the pitch will go up when the read speed of the read pointer is faster than the write speed of the write pointer. Conversely, the pitch will go down when the read speed of the read pointer is slower than the write speed of the write pointer.

Furthermore, the default address read speed is made the same as the address write speed so that the pitch change amount becomes zero. Indeed, the random shaking movement is added to the position of the read pointer by the vibrato process, but the random shaking movement is disregarded here for simplifying the discussion relating to the read pointer when a portamento occurs. The final pitch change amount determined by the final pitch process is obtained when the valuable delay module 24 receives the portamento trigger from the audio effect control module 23. At that time, the read position of the read address pointer may be caused to jump accordingly and, in addition, the address read speed is caused to increase or decrease from its default setting accordingly.

For example, in a case where the portamento trigger is received from the audio effect control module 23, if the pitch change direction based on the final pitch change setting process is negative (i.e., the pitch of the portamento initial value is lower than the default value), the address read position jumps in a direction closer to the address write position than the default address read position. Because the address read position jumps closer to the address write position than the default address read position, the delay time also becomes shorter than the default delay time. And the address read speed slows down and after that, as the amount of the pitch change attenuates (based on the pitch convergence function decided by the portamento initial value setting process), the address read speed gradually becomes faster. Furthermore, as it returns to the default address read position (the delay time returning to the default delay time), the address read speed also returns to the default read speed (the pitch change amount converges on zero). In this way, the variable delay module 24 (of the DSP 12) reads the divided audio signal from the RAM 16.

As a result of all the processes as explained above, the divided audio signal (read from the RAM 16 by the variable delay module 24) incorporates portamento effect. That is, the delay time is changed from its default setting (which is produced with the default read position and the default speed of the read pointer in the prescribed delay process). The pitch is jumped from the default pitch to the initial pitch change amount and it converges on zero with sufficient time duration for convergence (attenuates based on the pitch convergence function and finally the changed pitch returns to zero). The pitch finally reverts to the default pitch. The random shaking on pitch is provided at all times by the vibrato process (as discussed later) to the default pitch during the process. The reading of the divided audio signal on the RAM 16 may be processed repeatedly by the valuable delay module 24 as well as the fixed delay module 24, which will be discussed later.

The random signal generating module 25 may be configured to generate a random signal. The random signal generating module 25 may include three generating modules, namely a random generating module Ra (25*a*), a random generating module Rb (25*b*), and a random generating module Rc (25*c*). Each of these modules may be configured to generate a separate random signal.

The random signal generated by the random generating module Ra (25*a*) may be used by the portamento initial value setting process. By using the random signal generated by the random generating module Ra (25*a*), the initial pitch change amount with the pitch change direction and the pitch convergence function, both of which were determined by the portamento initial value setting process, can be randomly set on the input of a portamento trigger. (As such, the final pitch change amount, which is determined by the final pitch change decision process, can be made random when the portamento trigger is received.) Thus, by using the random generating module Ra (25*a*), the degree and the duration of portamento simulated by this audio effect signal may be varied. As a result, the simulation of portamento can approach that of the nuances of portamento in actual singing.

The random signal generated by the random generating module Rb (25*b*) may be used in the vibrato process. By using the random signal generated by the random generating module Rb (25*b*), the amount of shaking provided by the vibrato process can be made random. Thus, by using the random generating module Rb (25*b*), random vibrato can be given to portamento simulated by the audio effect signal, resulting in making the simulated portamento more natural and close to a real human singer's singing performance.

The random signal generated by the random generating module Rc (25*c*) may be used by the amplitude control module 29, as explained later. As such, the amplitude change amount of the signal controlled by the amplitude control module 29 can be made random.

The crossfade module 27 may be configured to crossfade the audio effect signal A (output from the variable delay module 24) and the audio effect signal B (output from the fixed delay module 26) and then to output the resulting signal to the mixer 28.

As noted above, the crossfade module 27 may include the first amp 27*a* and the second amp 27*b*. The first amp 27*a* may be configured to amplify the audio effect signal A. The first amp 27*a* is controlled based on the first control signal of the audio effect control module 23 such that an amplification rate of the first amp 27*a* is based on the first control signal. The second amp 27*b* may be configured to amplify audio effect signal B. The second amp 27*b* is controlled based on the second control signal of the audio effect control module 23 such that an amplification rate of the second amp 27*b* is based on the second control signal.

Specifically, when a switching from the audio effect signal B to the audio effect signal A, the audio effect control module 23 outputs the first control signal and the second control signal to the crossfade module 27 that gradually causes a reduction of an amplification rate of the second amp 27*b* as an amplification rate of the first amp 27*a* is increased. Accordingly, while the audio level of audio effect signal B is continuously, gradually reduced to a sound volume of zero, the audio level of audio effect signal A may be continuously, gradually increased from a sound volume level zero. That is, the crossfade module 27 can crossfade a signal from audio effect signal B to audio effect signal A and output to the mixer 28.

When portamento occurs, the pitch of the audio effect signal A may be caused to rapidly change. This may occur because the position of the read pointer jumps a relatively large amount from the initial read position located just before the portamento happens to the new read position located just after the portamento happens. The rapid change of the read position on waveform memory may produce noise. However, this noise can be suppressed substantially by the crossfade because the crossfade module 27 has just started when this noise occurs, so the sound level of the audio effect signal A that has a simulated sound of portamento having this noise which is to be output to the mixer 28 is still almost fully attenuated close to a sound volume of zero. Accordingly, as mentioned above, even if the noise is output from the variable delay module 24, the noise can be suppressed by the crossfade module 27.

The mixer 28 may mix (or add) together the audio effect signal A (output from the first amp 27*a*) and the audio effect signal B (output from the second amp 27*b*) and then output the mixed signal to the amplitude control module 29. The mixed signal may have an amplitude.

The amplitude control module 29 may be configured to change the amplitude of the mixed signal based on the signal generated by the random generating module Rc (25*c*). The signal is then output to the final stage mixer 31.

The audio signal amp 30 may configured to amplify the audio signal received from the DSP_IN terminal 12*a*. Then, the audio signal amp 30 may output the amplified audio signal to the final stage mixer 31.

The final stage mixer 31 may mix (or add) the mixed signal output from the amplitude control module 29 (i.e., the signal produced by mixing the audio effect signal A and the audio effect signal B) and the amplified audio signal output from the audio signal amp 30 (i.e., the signal produced by amplifying the audio signal input to the DSP_IN terminal 12*a*). Then, the final stage mixer 31 may output the final mixed signal to the DSP_OUT terminal 12*b*.

FIG. 3 is a flowchart of the signal process executed by the DSP 12 (e.g., FIGS. 1-2) according to an embodiment of the present invention. In particular, the signal process is a doubling process. The doubling process may be executed repeatedly while the power to the effect device 1 (e.g., FIG. 1) is ON. The doubling process may employ (but is not limited to) flags, such as a Now_Con_Flag and an Old_Con_Flag, and variables, such as a Now_Level, an Old_Level, and t. The Now_Con_Flag and the Old_Con_Flag may be provided in the prescribed region of the RAM 16 (e.g., FIG. 1).

With reference to FIGS. 1-3, The Now_Con_Flag is a flag that indicates whether the detected result (of the audio signal input to the DSP_IN terminal 12*a* by the consonant detection module 21) is a consonant. For instance, when the detected result is a consonant, the Now_Con_Flag is set to 1; when the detected results is not a consonant (i.e., the detected result is a vowel), the Now_Con_Flag is set to 0.

The Old_Con_Flag is a flag that indicates where the detected result of the previous time (of the audio signal input to the DSP_IN terminal 12*a* by the consonant detection module 21) is a consonant. For instance, when the detected result of the previous time is a consonant, the Old_Con_Flag is set to 1; when the detected results of the previous time is not a consonant (i.e., the detected result of the previous time is a vowel), the Old_Con_Flag is set to 0.

The Now_Level is a variable that indicates the input level (sound volume level) of the audio signal input to the DSP_IN terminal 12*a*. The Old_Level is a variable that indicates the input level (sound volume level) of the previous time of the audio signal input to the DSP_IN terminal 12*a*.

Furthermore, t is a variable that indicates the count value of the counter (not illustrated) provided to the RAM 16. Furthermore, when the audio signal input to the DSP_IN terminal 12*a* is detected as a consonant, or when the input level (sound volume level) of the audio signal input to the DSP_IN terminal 12*a* is at or below a threshold value Lc, this counter starts to count up (e.g., step S7). This counter counts up variable t every time step S7 is executed. In other cases, for instance, when an audio signal input to the DSP_IN terminal 12*a* is detected to be a vowel, and when the input level (sound volume level) of an audio signal input to the DSP_IN terminal 12*a* exceeds the threshold value Lc, the counter stops counting and the counter is cleared to 0 (e.g., step S15).

In step S1, the initialization process is executed in which the respective flags of the Now_Con_Flag and the Old_Con_Flag, and the respective variables of the Now_Level, the Old_Level, and t are set to zero.

In step S2, the value of the Old_Con_Flag is replaced by the value of the Now_Con_Flag, and the value of the Old_Level is replaced by the value of the Now_Level (S2). In other words, the respective values for the current time replace the corresponding values for the previous time.

In step S3, the audio signal input to the DSP_IN terminal 12*a* is detected. In step S4, the value of the input level (sound volume level) of the detected audio signal is set to the Now_Level.

In step S5, the detected audio signal (of step S3) is processed to determine whether it is a consonant or a vowel (S5). This process may be performed as known in the art, for example as disclosed in (but not limited to) Japanese patent number 2529207 and Japanese patent publication number H11-249658, both of which are herein incorporated by reference in their entirety.

If the process of step S5 determines that the detected audio signal is a consonant (S5: Yes), the Now_Con_Flag is set to "1" (step S6). Accordingly, in step S7, the counter begins to count. Then in step S8, the fixed delay process, which outputs the audio effect signal B from the fixed delay module 26, is executed.

Specifically, the position of the read address pointer is set to a prescribed time from the position of the write address pointer (e.g., a position at which a 20 ms delay occurs), and the reading of the divided audio signal from the RAM 16 at the same speed as the write speed of the write pointer. The divided audio signal is acquired from the RAM 16. The acquired audio signal is output to the second amp 27*b* of the crossfade module 27 as the audio effect signal B.

After step S8, the process shifts to step S17, which is discussed later. Thus, in a case where, the detected audio signal is a consonant (S5: Yes), the fixed delay process (S8) is executed (and the Now_Con_Flag is set to "1" (S6) and the counter starts (S7)).

If the process of step S5 determines that the detected audio signal is not a consonant (i.e., it is determined to be a vowel) (S5: No), the Now_Con_Flag is set to "0" (step S9). Then in step S10, the process determines whether the value of the Now_Level is larger than the threshold value Lc.

If, during step S10, the value of the Now_Level is less than the threshold level Lc (S10: No), regardless of whether or not the detected audio signal is a vowel, the process shifts to step S7 (i.e., the portamento initial value setting process of step S13 is not executed). Furthermore, even in a case where the audio signal detected in step S3 is silent, the Now_Level may be determined to not be greater than the threshold value (S10: No). Then in step S8, the fixed delay process, which outputs the audio effect signal B from the fixed delay module 26, is executed.

After step S8, the process shifts to step S17, which is discussed later. Thus, in a case where (i) the detected audio signal is a vowel (S5: No) and (ii) the Now_Level is less than the threshold level Lc (S10: No), the fixed delay process (S8) is executed (and the counter starts if the t=0 or count up if the t>0 (S7)). This case is distinguished, for instance from when the detected audio signal is a consonant (S5: Yes) in that the Now_Con_Flag remains at 0.

If, during step S10, the value of the Now_Level is larger than the threshold value Lc (S10: Yes) one or more of the following steps may occur.

In step S11, the process determines whether the Old_Con_Flag is 1 (i.e., whether the detected result of the previous time is a consonant). That is, there was a change from a consonant (at the previous time) to a vowel (the current time). If the Old_Con_Flag is 1 (S11: Yes), the process shifts to step S12.

In step S12, the process determines whether t, which indicates the count value of the counter (that was started in step S7), amounts to (or exceeds) a predetermined time Ts. If t is equal to or greater than the time Ts (S12: Yes), the effect device 1 outputs a portamento trigger from the audio effect control module 23 to the variable delay module 24. Accordingly, the portamento initial value setting process, which determines the initial pitch change amount with the pitch change direction and the pitch convergence function, is executed (step S13). The process then shifts to step S15 (discussed later).

Thus, in a case where (i) the detected audio signal is a vowel (S5: No), (ii) the Now_Level is more than the threshold level Lc (S10: Yes), (iii) the detected audio signal at the previous time was a consonant (S11: Yes), and (iv) t is equal to or greater than the time Ts (S12: Yes), the variable delay process (as described later with respect to step S16) occurs (along with the portamento initial value setting process (S13) and the clearing of the counter (S15)).

If t is less than the time Ts (S12: No), the process shifts to the step S15. As such, the portamento initial value setting processing of step S13 is not executed to prevent the audio effect signal A from being excessively generated (i.e., too many occurrences).

Thus, in a case where (i) the detected audio signal is a vowel (S5: No), (ii) the Now_Level is more than the threshold level Lc (S10: Yes), (iii) the detected audio signal at the previous time was a consonant (S11: Yes), and (iv) t is less than the time Ts (S12: No), the variable delay process (as described later with respect to step S16) occurs (along with the clearing of the counter (S15)). This case is distinguished from above (512: Yes) in that the portamento initial value setting process (S13) is not executed.

If the Old_Con_Flag is 0 (S11: No), the process determines whether the value of the Old_Level is greater than the threshold value Lc (step S14). If the value of the Old_Level is below the threshold value Lc (S14: No), the process shifts to step S12. As noted above, when t is equal to or greater than the time Ts (S12: Yes), the portamento initial value setting process is executed and then proceeds to step S15 as discussed.

Thus, in a case where (i) the detected audio signal is a vowel (S5: No), (ii) the Now_Level is more than the threshold level Lc (S10: Yes), (iii) the detected audio signal at the previous time was a vowel (S11: No), (iv) the Old_Level is not greater than the threshold value Lc (S14: No), and (v) t is equal to or greater than the time Ts (S12: Yes), the variable delay process (as described later with respect to step S16) occurs (along with the portamento initial value setting process (S13) and the clearing of the counter (S15)).

If the Old_Level is below the threshold value Lc (S14: No) and the time t is less than time Ts (S12: No), the process proceeds to step S15 as discussed. Thus, in a case where (i) the detected audio signal is a vowel (S5: No), (ii) the Now_Level is more than the threshold level Lc (S10: Yes), (iii) the detected audio signal at the previous time was a vowel (S11: No), (iv) the Old_Level is not greater than the threshold value Lc (S14: No), and (v) t is less than the time Ts (S12: No), the variable delay process (as described later with respect to step S16) occurs (along with the clearing of the counter (S15)).

Furthermore, during step S14, if the value of the Old_Level is greater than the threshold value Lc (S14: Yes), the process shifts to step S15. Thus, in a case where (i) the detected audio signal is a vowel (S5: No), (ii) the Now_Level is more than the threshold level Lc (S10: Yes), (iii) the detected audio signal at the previous time was a vowel (S11: No), and (iv) the Old_Level is greater than the threshold value Lc (S14: Yes), the variable delay process (as described later with respect to step S16) occurs (along with the clearing of the counter (S15)). These last two cases are distinguished from the previous case (S12: Yes) in that the portamento initial value setting process (S13) is not executed.

Thus, in various embodiments, if t is greater than (or equal to) the predetermined time Ts (S12: Yes), the portamento initial value setting process may be executed. As discussed, they may occur in two cases. The first case occurs where (i) the detected audio signal is a vowel (S5: No), (ii) the Now_Level is more than the threshold level Lc (S10: Yes), (iii) the detected audio signal at the previous time was a consonant (S11: Yes), and (iv) t is equal to or greater than the time Ts (S12: Yes). The second case occurs where (i) the detected audio signal is a vowel (S5: No), (ii) the Now_Level is more than the threshold level Lc (S10: Yes), (iii) the detected audio signal at the previous time was a vowel (S11: No), (iv) the Old_Level is not greater than the threshold value Lc (S14: No), and (v) t is equal to or greater than the time Ts (S12: Yes).

In step S15, the counter is stopped and cleared. In step S16, the variable delay process is executed, as described in FIG. 4, which is a flowchart illustrating the variable delay process executed by the variable delay module 24 (e.g., FIG. 2).

On the other hand, if the portamento initial value setting process (S13) has not been executed for sufficiently long time, no portamento attenuation process (S22) is executed. This is because the pitch attenuation converges on zero with sufficient time duration for convergence in a case the detected audio signal is a vowel and the input level (sound volume level) goes above the threshold level Lc at previous time and this time, and/or the input level continues to be above the threshold level Lc for sufficiently long time, for instance.

With respect to the variable delay process as shown in FIG. 4, first, a delay process is executed (step S20). The delay process carries out a prescribed delay like that of the fixed delay module 26. As discussed, this process occurs for both of the fixed delay process (S8) and the variable delay process (S16). Likewise, this process occurs all the time whether or not the portamento initial value setting process (S13) is executed.

Next, in step S21, a vibrato process is executed. The vibrato process determines the amount of shaking (vibrato) provided to the changed pitch. The signal generated by the random generating module Rb (25*b*) may be used in the vibrato process. By using the signal generated by the random generating module Rb (25*b*), the amount of shaking provided by the vibrato process can be made random. As discussed, this process occurs at all times whether or not the portamento initial value setting process (S13) is executed.

In step S22, a portamento attenuation process is executed. When the pitch of the divided audio signal is changed by the pitch change amount with the pitch change direction (as determined in step S13), the portamento attenuation process employs an pitch convergence function to determine the degree of attenuation (attenuation speed) in order to cause the change amount corresponding to the elapsed time to converge on zero with sufficient time duration for convergence.

In step S23, a final pitch change process is executed. The process determines the final amount to change the pitch (and/or its direction) based on the results obtained in the portamento initial value setting process (S13), the vibrato process (S21), and the portamento attenuation process (S22).

In step S24, a divided audio signal acquisition process is executed. Here, in response to the final pitch change amount determined by the final pitch change process (S23), the read position of the read address pointer set by the delay process (S20) is caused to jump to the new position of the read pointer set by the final pitch change process (S23). Likewise, the address read speed is caused to increase or decrease from the default value. The variable delay module 24 acquires the divided audio signal from the RAM 16 that corresponds to the read address pointer read position and the address read speed. The variable delay module 24 outputs the acquired signal to the first amp 27*a* of the crossfade module 27 as audio effect signal A. Subsequent to step S24, the variable delay process ends.

After the variable delay process (step S16) or fixed delay process (step S8) is executed, a crossfade process is executed (step S17). After the audio effect signal A output from the variable delay module 24 and the audio effect signal B output from the fixed delay part 26 are crossfade by the crossfade module 27, the signals (each having an amplitude) are output to the mixer 28.

In step S18, a random modulation process is executed. In this step, the amplitudes of the mixed signals mixed in the mixer 28 are changed in response to the random signal output from the generating module Rc (25*c*) of the random signal generating module 25, and then output to the final stage mixer 31. After execution of step S18, the process returns to step S2.

As discussed, in various embodiments, the effect device 1 may be configured to execute the portamento initial value setting process (S13) in particular cases and then execute the variable delay process (S16). Thus, by use of the portamento initial value setting process and the variable delay process, the audio effect signal A, which includes a simulated portamento effect, can be generated. The effect device 1 may be configured such that in a case where (i) the divided audio signal detected this time is a vowel, (ii) the input level of the vowel distinguished this time exceeds the threshold value Lc, (iii) the audio signal detected the previous time is a consonant, and (iv) t is at or above the predetermined time Ts, the portamento initial value setting process is executed and then the variable delay process is executed to generate the audio effect signal A.

As noted, a consonant is a sound other than a vowel (the respective sounds of a, i, u, e, o), namely, the plosive sounds (the respective sounds of b, d, g, p, t, k), the fricative sounds (the respective sounds of v, z, f, s), the nasal sounds (the respective sounds of m, n), and the liquid sounds (the respective sounds of l, r). As such, switching from a consonant sound to a vowel sound, for example, when a nasal sound or a liquid sound switches to a vowel sound, the portamento effect signal A can be generated. This means the occurrences of the portamento effect signal A generation can be increased when compared with a conventional case where the portamento effect signal A is generated only when the voiceless sound is switched to voiced sound. In the conventional case, the portamento effect signal A cannot be generated when a nasal sound or a liquid sound switches to a vowel sound because all of these sounds belong to voiced sounds.

In addition, as discussed, the effect device 1 may be configured such that in a case where (i) the audio signal detected the previous time is a vowel, (ii) the divided audio signal detected this time also is a vowel, (iii) the input level of the vowel distinguished the previous time is below a threshold value Lc, (iv) the input level of the vowel distinguished this time exceeds the threshold value Lc, and (v) t is at or above the predetermined time Ts, the portamento initial value setting process is executed and then the variable delay process is executed to generate the audio effect signal A. Accordingly, an input audio signal can simulate portamento (and number of instances it can be simulated can be increased), not only when the inputted audio signal changes from a consonant to a vowel, but also when a vowel changes to a vowel and the above conditions are met.

In addition, as discussed, the effect device 1 may be configured such that in a case where (i) a vowel is detected and (ii) the input level of the vowel is below the threshold level Lc (S10: No), the portamento initial value setting process (S13) is not executed and, accordingly, the audio effect signal B is generated.

In addition, as discussed, the effect device 1 may be configured such that if t is less than the predetermined time Ts, the portamento initial value setting process (S13) is not executed and then the fixed delay process by the fixed delay module 26 is executed to generate the audio effect signal B. Accordingly, portamento is not simulated as often, which allows it to seem more natural (e.g., as is often like a human singer entering portamento). Generally, a human singer enters portamento as a result of an emotional expression of lyrics during singing. Once the singer enters portamento, it is sustained for a certain duration (e.g., holding a syllable to accentuate the phrase) with portamento. It will be unnatural if the portamento effect should be triggered so frequently having less than the duration time for portamento. A human singer is unlikely to enter portamento, for example, in the middle of a fast-paced lyric sequence. Thus, to sound natural, the effect device 1 (according to various embodiments) would not simulate portamento in such a case.

In various embodiments, the variable delay module 24 and the fixed delay module 26 commence acquisition of the divided audio signal after a certain prescribed time, which may be regarded as the default delay setting (e.g., 20 ms), from when the audio signal is inputted to the DSP_IN terminal 12*a*.

When portamento is simulated, the variable delay module 24, as described in the disclosure, may add (or change) a delay amount, which corresponds to the pitch change randomly processed by the pitch final change decision process, to the 20 ms delay.

Because the divided audio signal from the variable delay module 24 and the fixed delay module 26 are crossfade together, the audio effect signal, which is to be mixed with the inputted audio signal, can be delayed with respect to the inputted audio signal. Because the divided audio signal obtained after crossfade processing is always delayed, during the period the audio signal is being input from the DSP_IN terminal 12*a*, the unison effect can be provided at all times.

In addition, the delay (e.g., 20 ms) may allow the effect device 1 to execute the required processes (regarding detection and judgment) to the input signal before generating the audio effect signals A and B, such as (but not limited to) those described in the disclosure. Thus, during the delay time, the detection process of a consonant or a vowel (S5), the audio level (S10) and other processes required for the portamento generating process can be executed while taking some time for each process during delay time without burdening the system.

Furthermore, in the doubling effector 1, because the final pitch change amount decided in the pitch final change decision process can be randomly changed, for instance, whenever the portamento trigger is output, the read position of the read address pointer and the address read speed can be changed randomly. This allows the effect device 1 to obtain a unison effect that can be varied greatly. As a result, the simulation of portamento and the unison effect can be made natural with a simple configuration.

In various embodiments, the time Ts may be decreased. As such, the rate at which the portamento initial value setting process is executed is increased (i.e., portamento will occur more often). In other cases, the time Ts may be increased. As such, the rate at which the portamento initial value setting process is executed is decreased (i.e., portamento will occur less often). Accordingly, the rate at which portamento is simulated (i.e., more often or less often) can be adjusted as needed.

In various embodiments, the threshold value Lc may be decreased. As such, the rate at which the portamento initial value setting process is executed is increased (i.e., portamento will occur more often). In other cases, the threshold value Lc may be increased. As such, the rate at which the portamento initial value setting process is executed is decreased (i.e., portamento will occur less often). Accordingly, the rate at which portamento is simulated (i.e., more often or less often) can be adjusted as needed.

In various embodiments, the pitch convergence function decided by the portamento initial value setting process is a function for causing the initial value of the change amount of the pitch of the divided audio signal that was set in the portamento initial value setting process (S13) to converge on zero with sufficient time duration for convergence. In other embodiments, the pitch convergence function may be modified to cause the initial value of the change amount of the pitch to converge to some other suitable value.

In various embodiments, the effect device 1 may employ the time Ts and the threshold value Lc. In other embodiments, the effect device may employ one or both these along with an individual modulation signal (e.g., a sine wave of about several Hertz). The individual modulation signal may be randomly modulated, for example in a manner like that previously described. Such embodiments may provide a more varied portamento.

In various embodiments, in a case where the divided audio signal distinguished the previous time is a vowel (S11: No), the divided audio signal distinguished this time is also a vowel (S5: No), the input level of the vowel distinguished the previous time is below the threshold value Lc (S14: No), and the input level of the vowel distinguished this time exceeds the threshold value Lc (S10: Yes), the decision of step S12 is implemented. In other embodiments, an increment value may be determined based on the difference between the input level of the vowel distinguished this time and the input level of the vowel distinguished the previous time. Accordingly, if the increment value exceeds a prescribed value, the decision of step S12 is implemented without executing one or both of steps S10 and S14.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. An effect device comprising:

an input means for inputting an audio signal;

an effect providing means for acquiring the audio signal at a plurality of times, the effect providing means for providing an effect to the acquired audio signal to produce an audio effect signal; and an output means for outputting the audio effect signal;

the effect providing means comprising:

a determination means for determining whether the acquired audio signal is a vowel or a consonant;

a detection means for detecting whether the acquired audio signal was switched from a consonant to a vowel;

a first change means for changing a pitch of the acquired audio signal by an amount when the detection means detects that the acquired audio signal was switched from a consonant to a vowel;

a first convergence means for converging the amount the pitch is changed by the first change means to a value based on a prescribed function; and a first output means for outputting the converged audio signal as the audio effect signal to the output means.

2. The effect device of claim 1, the effect providing means comprising:

an amplitude detection means for detecting an amplitude of the acquired audio signal when the detection means detects that the acquired audio signal was switched from a consonant to a vowel; and an amplitude decision means for deciding whether the amplitude is above a first threshold value;

the first change means comprising an execution means for executing the pitch change of the acquired audio signal, when the amplitude decision means decides that the amplitude is above the first threshold value.

3. The effect device of claim 1, the effect providing means comprising:

a vowel amplitude detection means for detecting an amplitude of the acquired audio signal;

a vowel amplitude decision means for deciding whether the amplitude is above a threshold when the determination means determines that the acquired audio signal is a vowel;

a continuous vowel detection means for detecting whether a previous audio signal acquired at a previous time is determined by the determination means to be a vowel, when the vowel amplitude decision means decides that the amplitude is above the threshold;

an amplitude change detection means for detecting a change amount between the amplitude of the acquired audio signal and the amplitude of the previous acquired audio signal, when the continuous vowel detection means detects the previous audio signal is a vowel;

an amplitude change decision means for deciding whether the change amount is above a prescribed value;

a second change means for changing the pitch of the acquired audio signal by an amount, when the amplitude change decision means decides the change amount is above the prescribed value;

a second convergence means for converging the amount the pitch is changed by the second change means to a value based on the prescribed function; and a second change output means for outputting the converged audio signal, received from the second convergence means, as the audio effect signal to the output means.

4. The effect device of claim 3, the effect providing means comprising:

a timing means for timing a sum amount of time when the vowel amplitude detection means detects the acquired audio signal was a vowel and the vowel amplitude decision means decides the amplitude of the voice is less than the threshold, and when the determination means determines the acquired audio signal is a consonant; and a timing decision means for deciding whether the sum amount of time exceeds a prescribed time;

the second change means comprising a time execution means for executing the pitch change of the acquired audio signal, when the timing decision decides that the amount of time exceeds the prescribed time.

5. The effect device of claim 3, the effect providing means comprising:

a pitch change means for randomly changing the amount the pitch is changed by the second change means.

6. The effect device of claim 4, the effect providing means comprising:

a convergence change means for randomly changing the prescribed function to change the degree of convergence accordingly.

7. The effect device of claim 5, the effect providing means comprising:

a shaking providing means for providing a random shaking to the pitch of the converged audio signal.

8. The effect device of claim 1, the effect providing means comprising:

a timing means for timing a sum amount of time when the vowel amplitude detection means detects the acquired audio signal was a vowel and the vowel amplitude decision means decides the amplitude of the voice is less than the threshold, and when the determination means determines the acquired audio signal is a consonant; and a timing decision means for deciding whether the sum amount of time exceeds a prescribed time;

the first change means comprising a time execution means for executing the pitch change of the acquired audio signal, when the timing decision decides that the amount of time exceeds the prescribed time.

9. The effect device of claim 1, the effect providing means comprising:

a pitch change means for randomly changing the amount the pitch is changed by the first change means.

10. The effect device of claim 1, the effect providing means comprising:

a convergence change means for randomly changing the prescribed function to change the degree of convergence accordingly.

11. The effect device of claim 1, the effect providing means comprising:

a shaking providing means for providing a random shaking to the pitch of the converged audio signal.

12. An effect device comprising:

an input device for inputting an audio signal;

an effect processor configured to acquire the audio signal at a plurality of times, the effect processor configured to provide an effect to the acquired audio signal to produce an audio effect signal, the effect processor comprising:

a determination module configured to determine whether the acquired audio signal is a vowel or a consonant;

an amplitude detection module configured to detect an amplitude of the acquired audio signal when the determination module determines that the acquired audio signal is a vowel;

an amplitude decision module configured to decide whether the amplitude is above a threshold;

a continuity detection module configured to detect whether a previous audio signal acquired at a previous time is determined by the determination module to be a vowel, when the amplitude decision module decides that the amplitude is above the threshold;

an amplitude change detection module configured to detect a change amount between the amplitude of the acquired audio signal and the amplitude of the previous acquired audio signal, when the continuity detection module detects the previous audio signal is a vowel;

an amplitude change decision module configured to decide whether the change amount is above a prescribed value;

a pitch change module configured to change the pitch of the acquired audio signal by an amount, when the amplitude change decision module decides the change amount is above the prescribed value;

a pitch convergence module configured to converge the amount the pitch is changed by the pitch change module to a value based on the prescribed function to produce the audio effect signal; and an output device for outputting the audio effect signal.

13. An effect device comprising:

an input terminal for receiving an audio signal;

a processor configured to produce a modified audio signal by applying an effect to the audio signal, the processor comprising:

a detecting module configured to detect whether the audio signal comprises a vowel sound or a consonant sound, and configured to detect whether the audio signal changed from a consonant sound to a vowel sound; and a pitch change module configured to change a pitch of the audio signal, and configured to change, based on a prescribed function, an amount the pitch of the audio signal is changed to produce the modified audio signal, when the detecting module detects that the audio signal changed from a consonant sound to a vowel sound; and an output terminal for outputting the modified audio signal.

14. The effect device of claim 13, the processor comprising:

an amplitude detection module configured to detect an amplitude of the audio signal when the detecting module determines that the audio signal changed from a consonant sound to a vowel sound, and configured to determine whether the amplitude exceeds a first threshold value;

the pitch change module configured to change the pitch of the audio signal when the amplitude exceeds the first threshold value.

15. The effect device of claim 13, the processor comprising:

an amplitude detection module configured to detect an amplitude of the audio signal when the detecting module determines that the audio signal changed was a vowel sound, and configured to determine whether the amplitude exceeds a second threshold value;

the amplitude detection module configured to determine an amplitude of the audio signal at a previous time when the amplitude detection module determines that the amplitude exceeds the second threshold value, and configured to determine whether the amplitude at the previous time exceeds the threshold value;

the amplitude detection module configured to calculate a difference between the amplitude of the audio signal and the amplitude of the audio signal at the previous time, and configured to determine whether the difference exceeds a prescribed value;

the pitch change module configured to change the pitch of the audio signal, and configured to change, based on the prescribed function, the amount the pitch of the audio signal is changed to produce the modified audio signal, when the amplitude detection module determines that difference exceeds the prescribed value.

16. The effect device of claim 13, the processor comprising:

a timer configured to measure a sum amount of a duration in which the amplitude of the audio signal is below the threshold value and a duration in which the audio signal is a consonant sound;

the pitch change module configured to change the pitch of the audio signal when the sum amount of the duration exceeds a predetermined value.

17. The effect device of claim 13, the processor comprising:

a random signal generator;

the pitch change module configured to randomly change the amount of pitch change based on a random signal generated by the random signal generator.

18. The effect device of claim 13, the processor comprising:

a random signal generator;

the pitch change module configured to randomly change the prescribed function based on a random signal generated by the random signal generator.

19. The effect device of claim 13, the processor comprising:

a random signal generator;

the pitch change module configured to provide random shaking to the audio signal based on a random signal generated by the random signal generator.

* * * * *